US007606656B2

(12) United States Patent
Dölker

(10) Patent No.: US 7,606,656 B2
(45) Date of Patent: Oct. 20, 2009

(54) PROCESS FOR AUTOMATICALLY CONTROLLING THE RAIL PRESSURE DURING A STARTING OPERATION

(75) Inventor: Armin Dölker, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 12/214,338

(22) Filed: Jun. 18, 2008

(65) Prior Publication Data

US 2008/0312807 A1 Dec. 18, 2008

(30) Foreign Application Priority Data

Jun. 18, 2007 (DE) ..... 10 2007 027 943

(51) Int. Cl.
*F02M 69/54* (2006.01)

(52) U.S. Cl. ..... 701/113; 123/456; 123/458; 123/491

(58) Field of Classification Search ..... 701/104, 701/113; 123/456, 457, 458, 491
See application file for complete search history.

(56) References Cited

U.S. PATENT DOCUMENTS

| | | | | |
|---|---|---|---|---|
| 6,035,829 | A * | 3/2000 | Hartke et al. | 123/447 |
| 6,293,251 | B1 * | 9/2001 | Hemmerlein et al. | 123/447 |
| 6,378,501 | B1 | 4/2002 | Hisato et al. | |
| 6,578,553 | B1 * | 6/2003 | Schubert et al. | 123/458 |
| 6,918,367 | B2 * | 7/2005 | Denz et al. | 123/179.17 |
| 7,017,549 | B2 | 3/2006 | Dölker | |
| 7,025,028 | B2 | 4/2006 | Dölker | |
| 7,040,291 | B2 * | 5/2006 | Veit | 123/458 |
| 7,240,667 | B2 | 7/2007 | Dölker | |
| 7,318,421 | B2 * | 1/2008 | Fukasawa | 123/491 |
| 7,448,361 | B1 * | 11/2008 | Pursifull et al. | 123/456 |
| 2008/0092852 | A1 | 4/2008 | Bucher et al. | |

FOREIGN PATENT DOCUMENTS

| | | |
|---|---|---|
| DE | 100 29 033 | 6/2001 |
| DE | 101 56 637 | 5/2003 |
| DE | 103 30 466 | 10/2004 |
| DE | 10 2004 061 474 | 6/2006 |
| DE | 10 2006 049 266 | 3/2008 |

* cited by examiner

*Primary Examiner*—Erick Solis
(74) *Attorney, Agent, or Firm*—Lucas & Mercanti, LLP; Klaus P. Stoffel

(57) ABSTRACT

A process for automatically controlling the rail pressure (pCR) in an internal combustion engine with a common-rail system during the starting operation, the process including: calculating control deviation from a nominal rail pressure and an actual rail pressure; calculating, in a pressure controller, a correcting variable for actuating a suction throttle on the basis of the control deviation; and the suction throttle determining the required quantity of fuel. After the engine has been started, an adaptation process is activated upon detection of a negative control deviation of the rail pressure (pCR) followed by a positive control deviation, as a result of which the correcting variable is changed temporarily in such way as to increase the amount of fuel being delivered.

8 Claims, 6 Drawing Sheets pCR
Rail
16
V3
15
VIST
Suction Throttle
with Pump
16
E3
B
PWM
Calculation
PWM-Signal
14
E2
dPWM
Calculation
dPWM
22
E7
ep
A
E1
di
Calculation
di
21
E6
ep
E
iSL
Pump Curve
13
VSL
Limit
12
nMOT
VR
Controller
11
Tn
kp
ep
pCR(SL)
pCR
Filter
17
pCR(IST)
18
K2
D
dTn
Calculation
dTn
20
E5
ep
K1
C
dkp
Calculation
dkp
19
E4
ep

PROCESS FOR AUTOMATICALLY CONTROLLING THE RAIL PRESSURE DURING A STARTING OPERATION

BACKGROUND OF THE INVENTION

The invention pertains to a process for automatically controlling the rail pressure in an internal combustion engine with a common rail system during a starting operation.

To achieve high injection quality and low pollutant emissions, the rail pressure in an internal combustion engine is automatically controlled by a common rail system. A closed-loop control circuit is known from DE 103 30 466 B3, in which the actual rail pressure is calculated from the raw rail pressure measurements and compared with the nominal rail pressure, which is the command variable. From the resulting control deviation, an automatic pressure controller calculates a volume flow rate as the correcting variable, which is then limited and converted to a pulse width modulation (PWM) signal. The PWM signal is sent to the magnetic coil of a suction throttle. This suction throttle influences the flow delivered by a low-pressure pump to a high-pressure pump, which then conveys the fuel to the rail while increasing its pressure. In this closed-loop control circuit, the two pumps, the suction throttle, and the rail correspond to the controlled system. The unpublished German patent application with the official file no. DE 10 2006 049 266.8 discloses the same closed-loop control circuit with the more precise statement that the volume flow rate is converted by the use of a characteristic pump curve to a nominal electric current, which then serves as the input variable for the PWM calculation.

In practice, the following problem can occur in this automatic pressure control circuit during the starting operation:

To calculate the PWM signal, the nominal electric current is multiplied by the ohmic resistance of the suction throttle coil and the (electric) line. The suction throttle is driven with negative logic; that is, the throttle is open when no current is passing through it. When the suction throttle is completely open, the volume flow rate delivered by the low-pressure pump arrives unthrottled at the high-pressure pump. When current is sent to the suction throttle, it closes the fuel line. To guarantee a reliable drive to zero, that is, a complete closing of the fuel line, it must be assumed that the ohmic resistance of the suction throttle coil and the (electric) line is at its maximum. The maximum resistance value is obtained at the maximum temperature of the suction throttle. In a permissible temperature range between −20° C. to 120° C., for example, the ohmic resistance of the suction throttle changes from about 2 ohms to 4 ohms, that is, by 100%. So that the high pressure can be reduced reliably to zero under all possible environmental conditions, the maximum fixed value of 4 ohms must be stored in the electronic control unit. At low temperatures, however, this leads to an improper calculation: because the actual resistance is low, the calculated PWM signal is too large. The suction throttle is thus driven toward the closed position. When the internal combustion engine is started in a cold environment, this has the result that, after the actual rail pressure has swung past the target value (negative control deviation), it swings back under the nominal rail pressure (positive control deviation) and continues to decrease until the pressure falls below the opening pressure of the injector nozzles. The internal combustion engine thus stops.

For the previously described automatic control circuit, this problem can be solved by providing another circuit to support the automatic rail pressure circuit, namely, a circuit for controlling the coil current as known from DE 10 2004 061 474 A1, for example. Because of the additional hardware, however, this solution is expensive.

Although DE 101 56 637 C1 describes a process for the open-loop and closed-loop control of the starting operation of an internal combustion engine, the goal of the process is to suppress pressure fluctuations by preventing an oscillation between open-loop and closed-loop control modes. No additional information can be derived from this source concerning the problem of interest described above.

SUMMARY OF THE INVENTION

The invention is based on the object of providing a process which ensures a reliable starting operation at little additional expense.

Pursuant to the invention, after the engine is started, a check is first run to determine whether an adaptation-triggering event has occurred. The triggering event is a detected negative control deviation of the rail pressure followed by a positive control deviation; that is, the actual rail pressure first swings beyond the nominal rail pressure and then swings back down below it again. Upon detection of this triggering event, the adaptation process is activated, which temporarily changes the correcting variable in such a way that the delivery rate is increased. This is done either by changing the correcting variable indirectly via a change in the controller components or by changing the correcting variable directly via a change in the nominal electric current or in the PWM signal. The controller components are changed by using a proportional coefficient to determine a P component and/or a reset time to determine an I component of the pressure controller. For the calculation, characteristic adaptation curves are provided for the proportional coefficient, the reset time, the nominal current, and the PWM signal. To increase operational reliability, the adaptation process is deactivated as soon as the control deviation falls below a limit value and remains locked in the deactivated state until the internal combustion engine is restarted.

As a result of the adaptation—without the need for any additional sensors—the dependence of the suction throttle resistance on temperature is compensated. The high-pressure control thus becomes more robust vis-à-vis temperature fluctuations. In practice, the internal combustion engine no longer stops during the engine-starting operation.

Other features and advantages of the present invention will become apparent from the following description of the invention.

BRIEF DESCRIPTION OF THE DRAWINGS

The drawings illustrate a preferred exemplary embodiment.

DETAILED DESCRIPTION OF THE INVENTION

Figure 1:
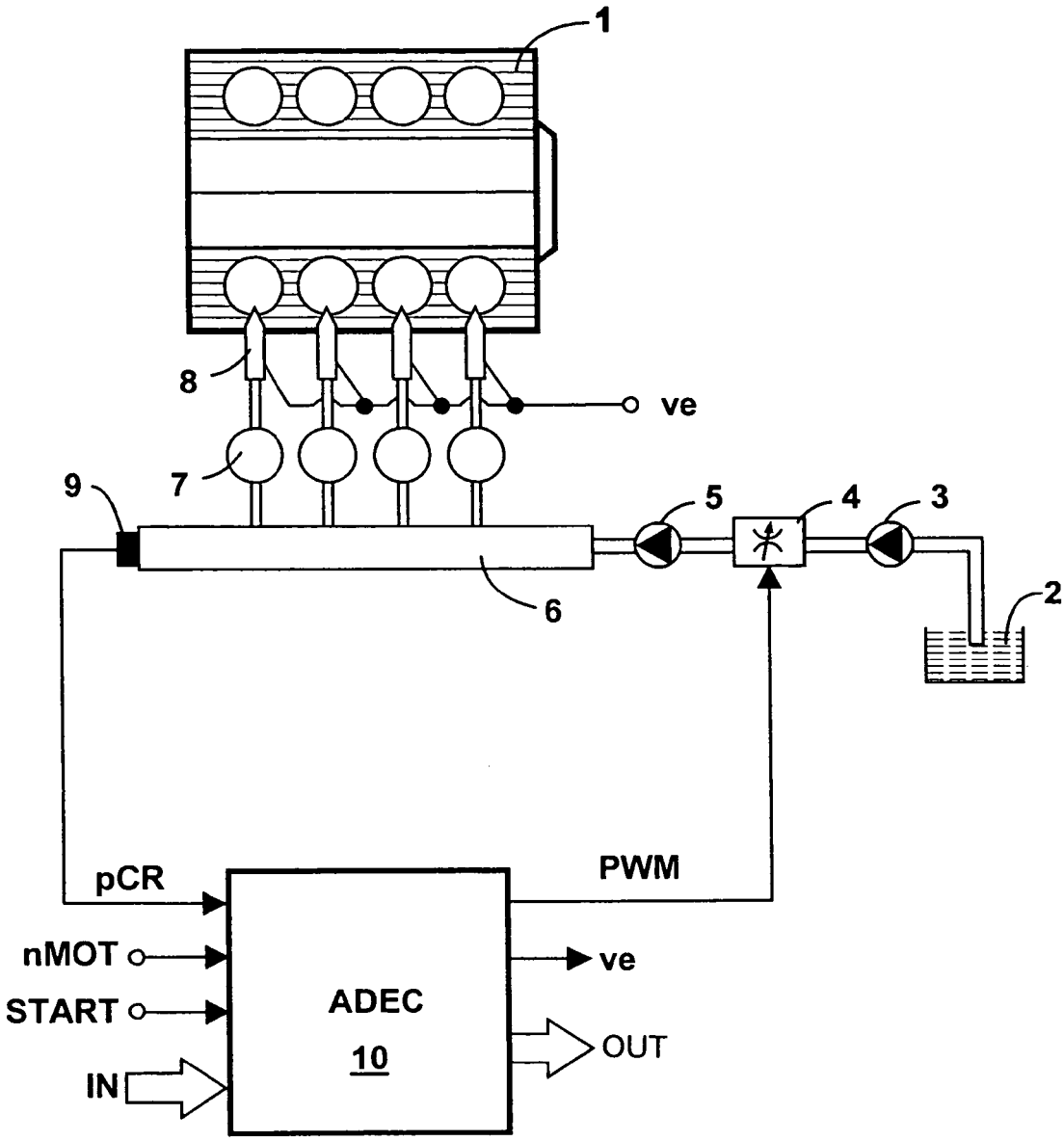
FIG. 1 shows a system diagram.

FIG. 1 shows a system diagram of an internal combustion engine 1 with a common rail system. The common rail system has the following components: a low-pressure pump 3 for conveying fuel from a fuel tank 2, a variable suction throttle 4 for influencing the volume flow rate of the fuel flowing through the line, a high-pressure pump 5 for conveying the fuel while increasing its pressure, a rail 6, (optional) individual storage units 7 for storing the fuel, and injectors 8 for injecting the fuel into the combustion chambers of the internal combustion engine 1.

The operating mode of the internal combustion engine 1 is determined by an electronic control unit (ADEC) 10. The electronic control unit 10 contains the standard components of a microcomputer system, such as a microprocessor, I/O elements, buffers, and memory elements (EEPROM, RAM). In the memory elements, the operating data relevant to the operation of the internal combustion engine 1 are stored in the form of characteristic fields/characteristic curves. Using them, the electronic control unit 10 calculates the output values from the input values. FIG. 1 shows by way of example the following input values: the rail pressure pCR, which is measured by a rail pressure sensor 9; an engine speed nMOT, a signal START indicating that the driver wishes to activate the internal combustion engine 1, and an input value IN. The input value IN combines, for example, the charging-air pressure of the exhaust gas turbocharger, the temperature of the coolant/lubricant, and the temperature of the fuel.

In FIG. 1, the output values of the electronic control unit 10 are a signal PWM for driving the suction throttle 4, a signal ve for driving the injectors 8, and an output value OUT. The output value OUT stands for the additional actuating signals used for open-loop and closed-loop control of the internal combustion engine 1, such as an actuating signal for activating a second exhaust-gas turbocharger for register charging.

Figure 2:
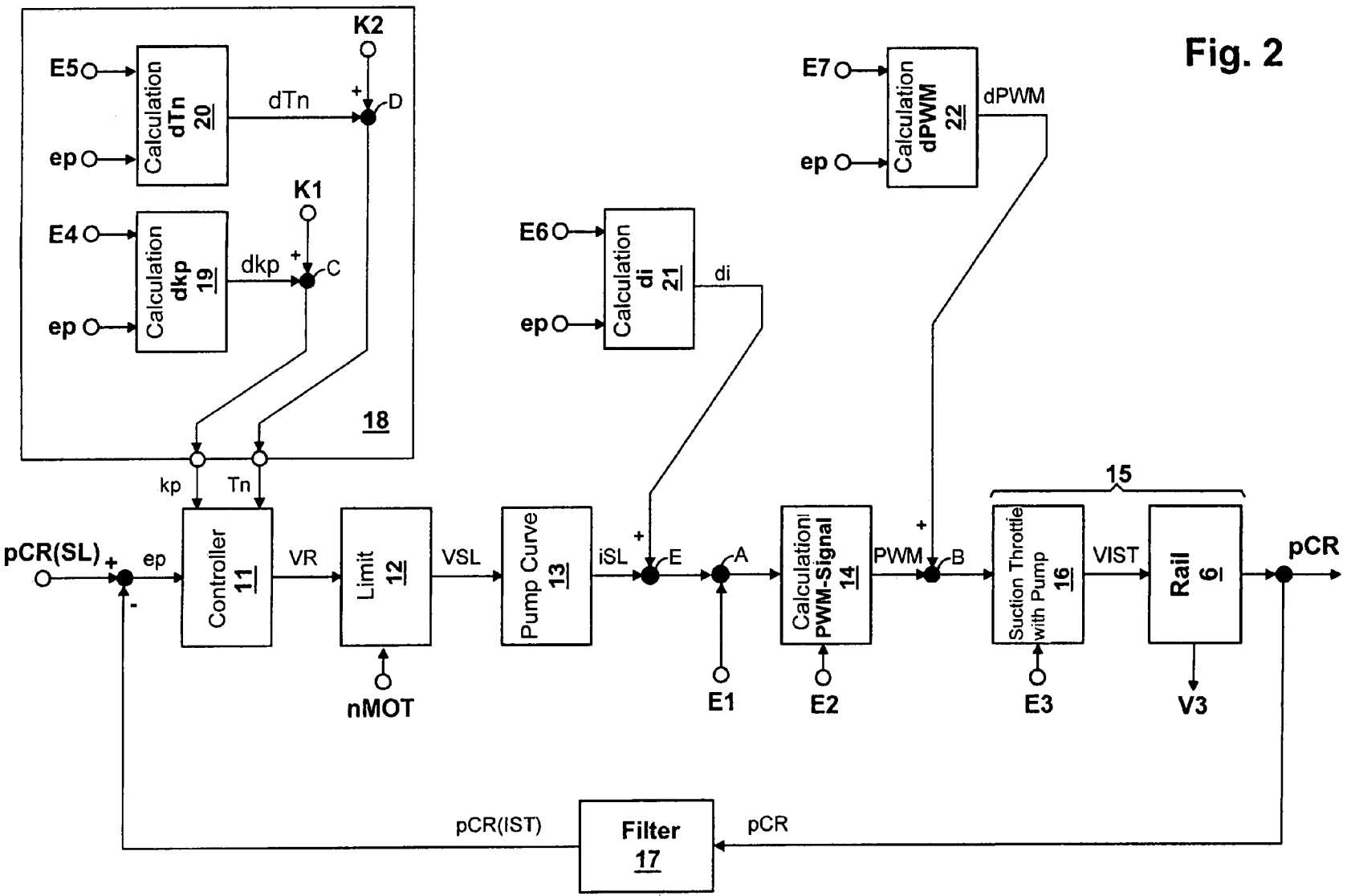
FIG. 2 shows a functional block diagram of the automatic control circuit with adaptation.

FIG. 2 shows an automatic pressure control circuit. The input values are a nominal rail pressure pCR(SL) as command variable, the engine speed nMOT, and input values E1-E3. The output value corresponds to the raw value of the rail pressure pCR, which represents the controlled variable. From the raw value of the rail pressure pCR, an actual rail pressure pCR(IST) is determined by means of a filter 17. This actual pressure is compared with the nominal value pCR(SL) at a summation point, from which a control deviation ep results. A correcting variable is calculated from the control deviation ep by an automatic pressure controller 11. Typically, the automatic pressure controller 11 is designed as a PIDT1 controller. The correcting variable corresponds to a volume flow rate VR. The physical unit of the volume flow rate is liters/minute. Optionally, the calculated nominal consumption can be added to the volume flow rate VR. The volume flow rate VR corresponds to the input variable for a limitation 12. The limitation 12 can be a function of speed, i.e., of the input variable nMOT. The output variable of the limitation 12 corresponds to a nominal volume flow rate VSL, to which, via a characteristic pump curve 13, a nominal electric current iSL is assigned. At a point A, the nominal current iSL is multiplied by the input variable E1. The input variable E1 stands for the ohmic resistance of the suction throttle coil and the (electric) line. This calculated voltage value is converted to the PWM-signal PWM of functional block 14, "calculation of the PWM signal". In this calculation, variations in the operating voltage are also taken into account in the form of input variable E2. The PWM-signal PWM is then sent to the controlled system 15. This consists of the suction throttle with high-pressure pump, designated by reference number 16, and the rail 6 with the (optional) individual storage units. The PWM-signal changes the path of the magnetic core of the suction throttle, as a result of which the output of the high-pressure pump can be freely influenced. The suction throttle is driven in negative logic; that is, it is completely open when no current is passing through it. The input variable E3 stands for the engine speed nMOT and the inlet pressure provided by the low-pressure pump 3. A volume flow rate V3 for consumption is delivered from the rail 6 and the individual storage units 7 by the injectors 8. Thus the automatic control circuit is closed.

According to the invention, the control circuit is now to be expanded by a functional block 18 for calculating an indirect adaptation, or by a calculation 21 for determining the adaptation value di for the current, or by a calculation 22 for determining a PWM adaptation value dPWM. The controller components and thus the correcting variable are changed indirectly in the functional block 18. The correcting variable is changed directly by the calculation 21 or by the calculation 22. A calculation 19 for determining a proportional adaptation value dkp and a calculation 20 for determining a reset time adaptation value dTn are combined in the functional block 18. Either of the two calculations 19 and 20 or both can be located in the functional block 18.

Figure 3:
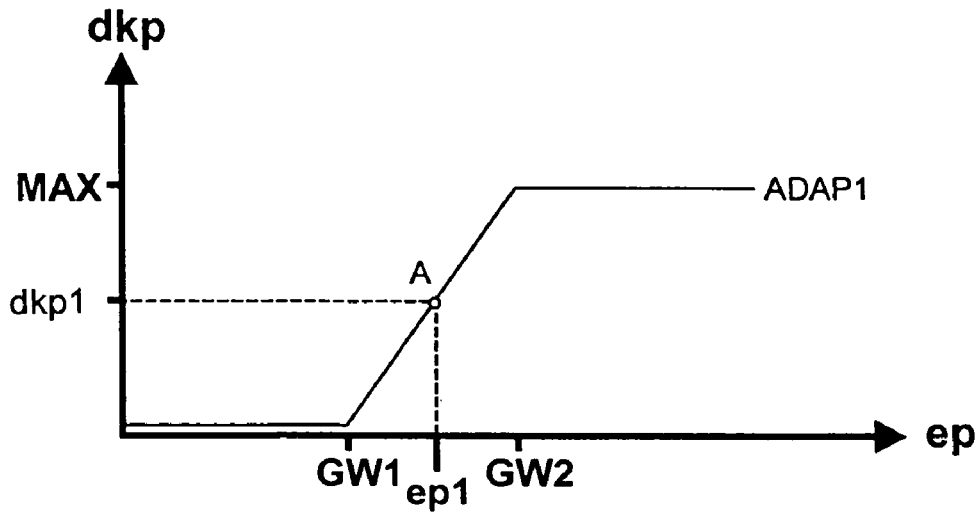
FIG. 3 shows a characteristic curve.
Figure 4:
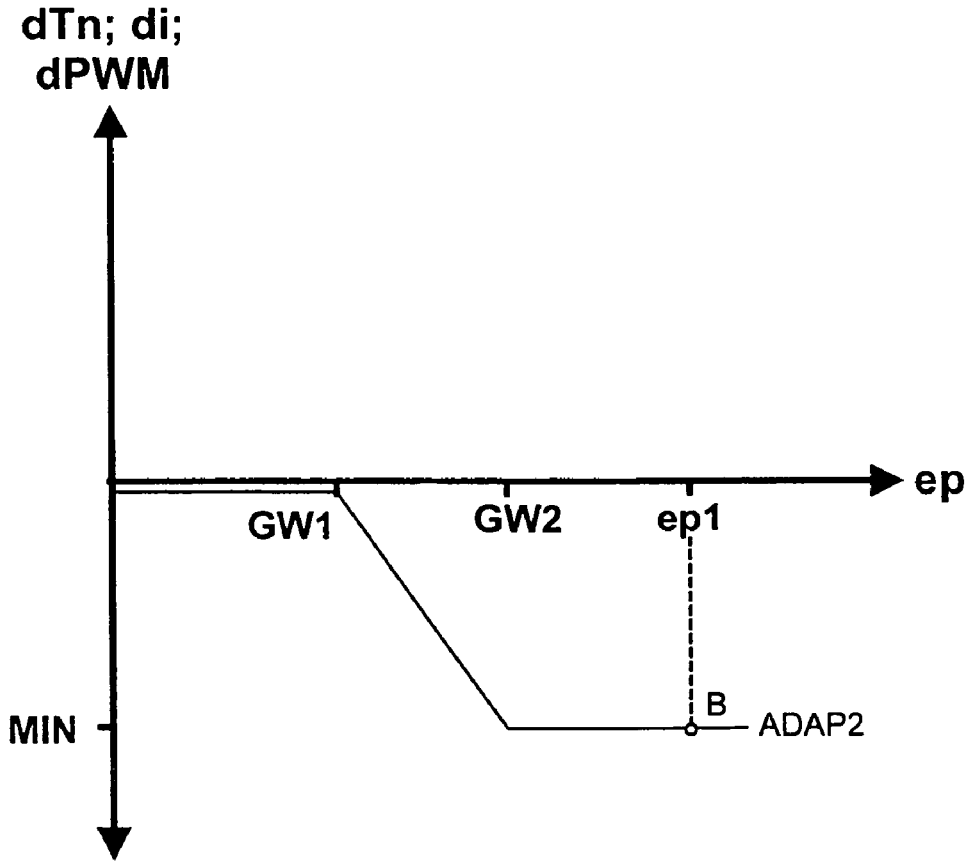
FIG. 4 shows a characteristic curve.

To implement the indirect adaptation by functional block 18, calculation 19 determines the proportional adaptation value dkp as a function of the control deviation ep and an input variable E4 by the use of a characteristic curve ADAP1, which is shown in FIG. 3. The input variable E4 combines the engine speed nMOT, two limit values of the control deviation, and a scanning time. At a point C, the proportional adaptation value dkp is added to a constant value K1. The result corresponds to the proportional coefficient kp. The P component of the pressure controller 11 is then calculated on the basis of the proportional coefficient kp and the control deviation ep. As a function of the control deviation ep and an input variable E5, calculation 20 determines the reset time adaptation value dTn by the use of a characteristic curve ADAP2, which is shown in FIG. 4. The input variable E5 combines the engine speed nMOT, two limit values of the control deviation, and the scanning time. At a point D, the reset time adaptation value dTn is added to a constant value K2. The result corresponds to the reset time Tn.

To implement a direct adaptation, in a first embodiment, calculation 21 determines the adaptation value di for the current as a function of the control deviation ep and an input variable E6 by the use of the characteristic curve ADAP2 (see FIG. 4). The input variable E6 combines the engine speed nMOT, two limit values of the control deviation, and the scanning time. At a point E, the nominal current iSL calculated by use of the pump characteristic 13 and the adaptation value di for the current are added together. Then the sum is multiplied at point A by the input variable E1, i.e., the ohmic resistance. In a second embodiment, calculation 22 determines the PWM adaptation value dPWM as a function of the control deviation ep and an input variable E7 by the use of the characteristic curve ADAP2 (see FIG. 4). The input variable E7 combines the engine speed nMOT, two limit values of the control deviation, and the scanning time. At point B, the PWM value determined by the PWM calculation 14 and the PWM adaptation value dPWM are added together.

The functionality of FIG. 2 consists in that, after an adaptation-triggering event has been detected, the correcting variable to be sent to the suction throttle is changed either indirectly or directly in such a way as to increase the allowable delivery rate. The indirect change takes place by way of the proportionality coefficient kp and/or the reset time Tn. The direct change takes place by way of the adaptation value di for the current or the PWM adaptation value dPWM. The adaptation-triggering event is present when, after the engine has been started, the actual rail pressure pCR(IST) swings beyond the nominal rail pressure pCR(SL) and then swings back under it.

FIG. 3 shows the characteristic curve ADAP1, by the use of which a proportional adaptation value dkp is assigned to a control deviation ep. The characteristic curve ADAP1 is composed of a first line segment, identical to the abscissa, a second line segment with a positive slope, and a third line segment parallel to the abscissa. In a range from the origin of the coordinates to the first limit value GW1, a proportional adaptation value dkp of zero is assigned to the control deviation ep by the use of the first line segment. In the range between the first limit value GW1 and the second limit value GW2, an increasingly large proportional adaptation value dkp is assigned to an increasingly large control deviation; for example, the positive value dkp1 is assigned to the control deviation ep1 at point A. In place of a rising line segment, other mathematical functions (parabola, hyperbola) can also be provided. In the range above the second limit value GW2, the same maximum value MAX is always assigned to the control deviation ep.

FIG. 4 shows the characteristic curve ADAP2, by the use of which the reset time adaptation value dTn, the adaptation value di for the current, or the PWM adaptation value dPWM is assigned to a control deviation ep. The characteristic curve ADAP2 consists of a first line segment identical to the abscissa, a second line segment with a negative slope, and a third line segment parallel to the abscissa. For example, by the use of the third line segment, the value MIN is assigned to a control deviation ep1 at point B. In practice, the characteristic curve ADAP2 can be set up differently for the various adaptation values (dTn, di, dPWM) with respect to the limit values and also with respect to the slope. In place of the second line segment, it is also possible to provide some other mathematical function, such as a parabolic or hyperbolic function.

FIG. 5 shows a starting and stopping operation. FIG. 5 consists of the subfigures 5A-5H. Each of these shows a certain variable as a function of time: FIG. 5A shows the engine speed nMOT; FIG. 5*b* shows the rail pressure pCR; FIG. 5C shows an engine status signal Motor AN; FIG. 5D shows a status signal for a first marker Mneg; FIG. 5E shows a status signal for a second marker Mpos; FIG. 5F shows an adaptation signal; FIG. 5G shows the course of the proportional coefficient kp; and FIG. 5H shows the course of the reset time Tn. FIGS. 5A and 5B show two different case examples. The dotted line characterizes the course according to the prior art. The solid line shows the course according to the invention. In the explanation below, a constant nominal rail pressure PCR(SL) of 600 bars is assumed, which is drawn in dash-dot line in FIG. 5B.

The process according to the prior art (dotted line) at low environmental temperature proceeds as follows:

At time t0, the starting operation is activated by sending current to the starter motor. The crankshaft of the internal combustion engine begins to turn. As yet, no fuel is being injected, however. After time t0, the engine speed nMOT increases until it reaches a starter motor speed of n1. At time t1, the engine speed nMOT reaches a speed threshold at which the speed signal can be reliably detected by the speed sensor. The engine-on signal Motor AN is then set to 1 (see FIG. 5C). Because the high-pressure pump 5 is mechanically connected to the crankshaft, it begins to deliver fuel to the rail as the crankshaft turns. As a result, the rail pressure pCR increases. At time t2, synchronization has been completed, so that the injection of fuel into the combustion chambers of the internal combustion engine can begin. As a result, the speed nMOT of the internal combustion engine increases toward the idling speed level of 600 rpm. At time t3, the engine speed nMOT exceeds the idling speed level and swings beyond it. The reason for this is the reaction time of the automatic speed control circuit. The course of the actual rail pressure pCR (IST), which also increases quickly in the period from t2 to t3 and then swings beyond the nominal rail pressure level of 600 bars, corresponds to the course of the engine speed nMOT. Because the actual rail pressure pCR(IST) is now greater than the nominal rail pressure pCR(SL), a negative control deviation ep is present. Because of the negative control deviation ep, the pressure controller reduces the correcting variable, as a result of which the suction throttle is driven toward its closed position. Because now less fuel is being conveyed by the high-pressure pump, the actual rail pressure pCR(IST) decreases until it swings below the nominal rail pressure pCR(SL) after time t4. Because of the low ambient temperature, however, the ohmic resistance of the suction throttle coil is lower than the fixed value stored in the electronic control unit. This leads to the result that the values calculated for the nominal current iSL and the PWM-signal PWM are too low. Thus the open cross section of the suction throttle becomes too small. Less fuel is therefore conveyed into the rail by the high-pressure pump 5, as a result of which the actual rail pressure pCR(IST) falls even farther. For example, after time t5, the actual rail pressure pCR(IST) falls below the pressure level of 580 bars with a falling tendency. At time t6, the actual rail pressure pCR(IST) falls below the opening pressure of the injectors, which can be, for example, 300 bars. The injectors are now unable to inject any more fuel into the combustion chambers of the internal combustion engine, and as a result the engine stops (see FIG. 5A).

Figure 5A:
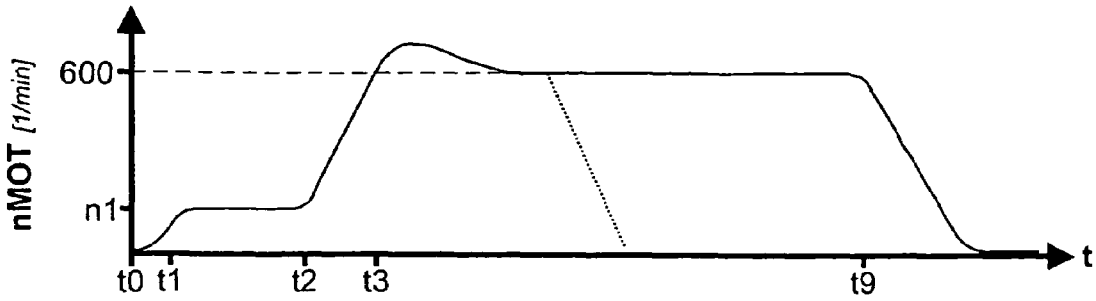
FIGS. 5A-5H show a starting operation as a timing diagram.
Figure 5B:
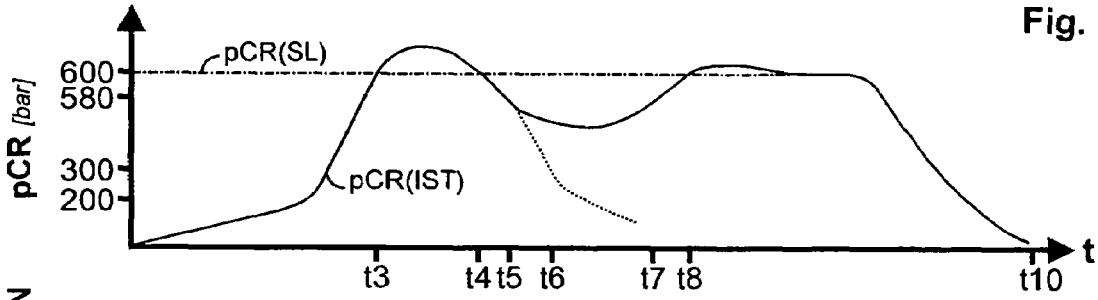
Figure 5C:
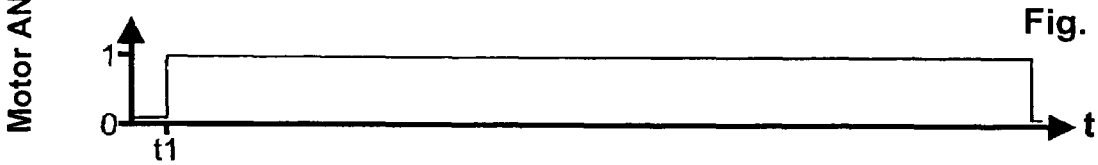
Figure 5D:
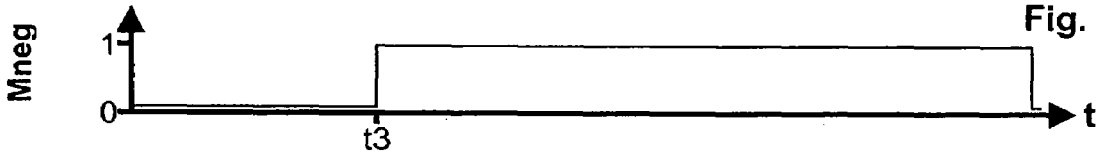
Figure 5E:
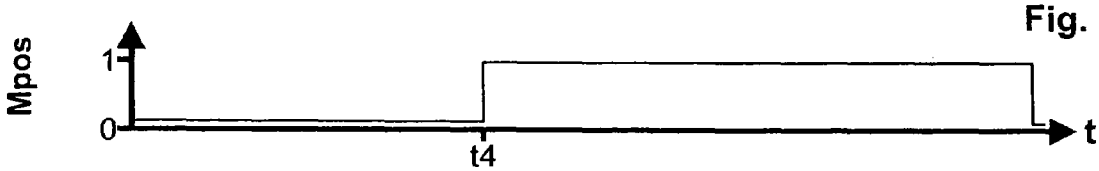
Figure 5F:
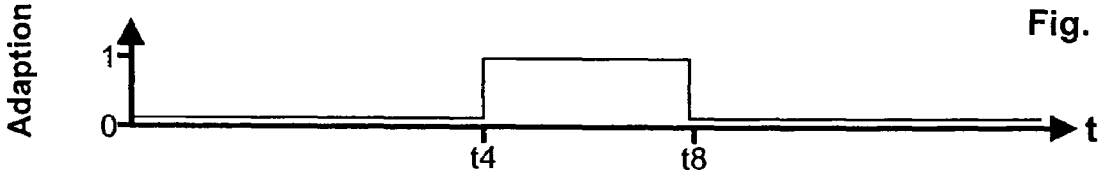
Figure 5G:
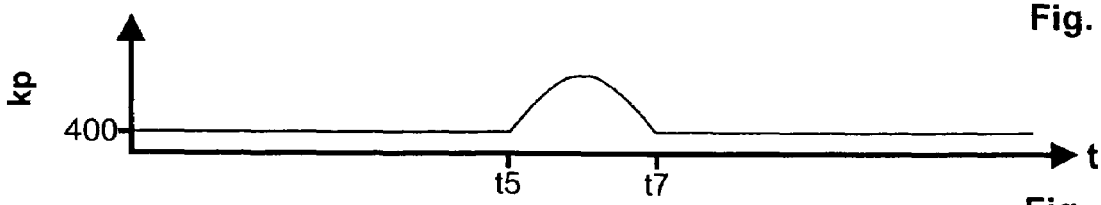
Figure 5H:
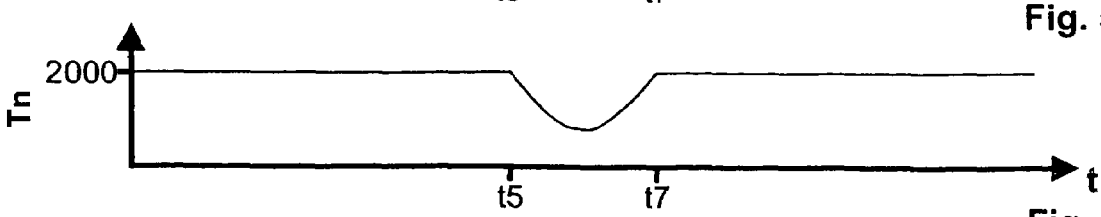

The process according to the invention (solid line) proceeds as follows:

After the engine has been started, a check is run to determine whether or not a negative control deviation (ep<0) is present. In practice, the control deviation ep is compared for this purpose with a limit value such as −10 bars. This is the case after time t3, because the actual rail pressure pCR(IST) swings beyond the nominal rail pressure pCR(SL). Upon detection that the actual rail pressure pCR(IST) has swung beyond the nominal rail pressure pCR(SL), the first marker Mneg is set. In FIG. 5D, its status changes from zero to one. The system then checks to see whether a positive control deviation (ep>0) is present. In practice, the control deviation ep is compared for this purpose with a limit value such as +10 bars. This is the case after time t4. Upon detection that the actual rail pressure pCR(IST) has swung below the nominal rail pressure pCR(SL), the second marker Mpos is set. In FIG. 5E, its status changes from zero to one. The overswing of the actual rail pressure pCR(IST) followed by an underswing of the actual rail pressure pCR(IST) is interpreted as an adaptation-triggering event, and therefore the adaptation process is activated. In FIG. 5F, therefore, the adaptation status changes from zero to one. Upon activation of the adaptation process, the correcting variable is changed temporarily so as to increase the delivery rate. In the example shown here, the correcting variable is changed by way of the proportional coefficient kp (FIG. 5G) and the reset time Tn (FIG. 5H). When adaptation is activated, the change in these control parameters takes place by way of the characteristic curve ADAP1 of FIG. 3 and the characteristic curve ADAP2 of FIG. 4. The courses of the two control parameters resulting from the adaptation are shown in the two FIGS. 5G and 5H for the period between t5 and t7. The adaptation process is terminated when the control deviation ep has become zero again. This is the case at time t8. In FIG. 5F, therefore, the adaptation status is set back from one to zero. At time t9, the internal combustion engine is turned off, as a result of which the engine speed nMOT in FIG. 5A decreases. To increase the operational reliability, the adaptation remains locked until it is determined that the engine has stopped. A stopped engine is detected when the engine speed nMOT is less than 80 rpm for a predetermined time such as 2.5 seconds. Once this condition is recognized, as it is at time t10, the two markers and the engine-on signal Motor AN are set back to zero.

Comparison of the course of the actual rail pressure pCR (IST) according to the prior art (dotted line) with that according to the invention (solid line) clearly shows that, when adaptation is used, the actual rail pressure pCR(IST) decreases to a lesser extent after the engine has been started, as a result of which the internal combustion engine is prevented from stopping.

Figure 6:
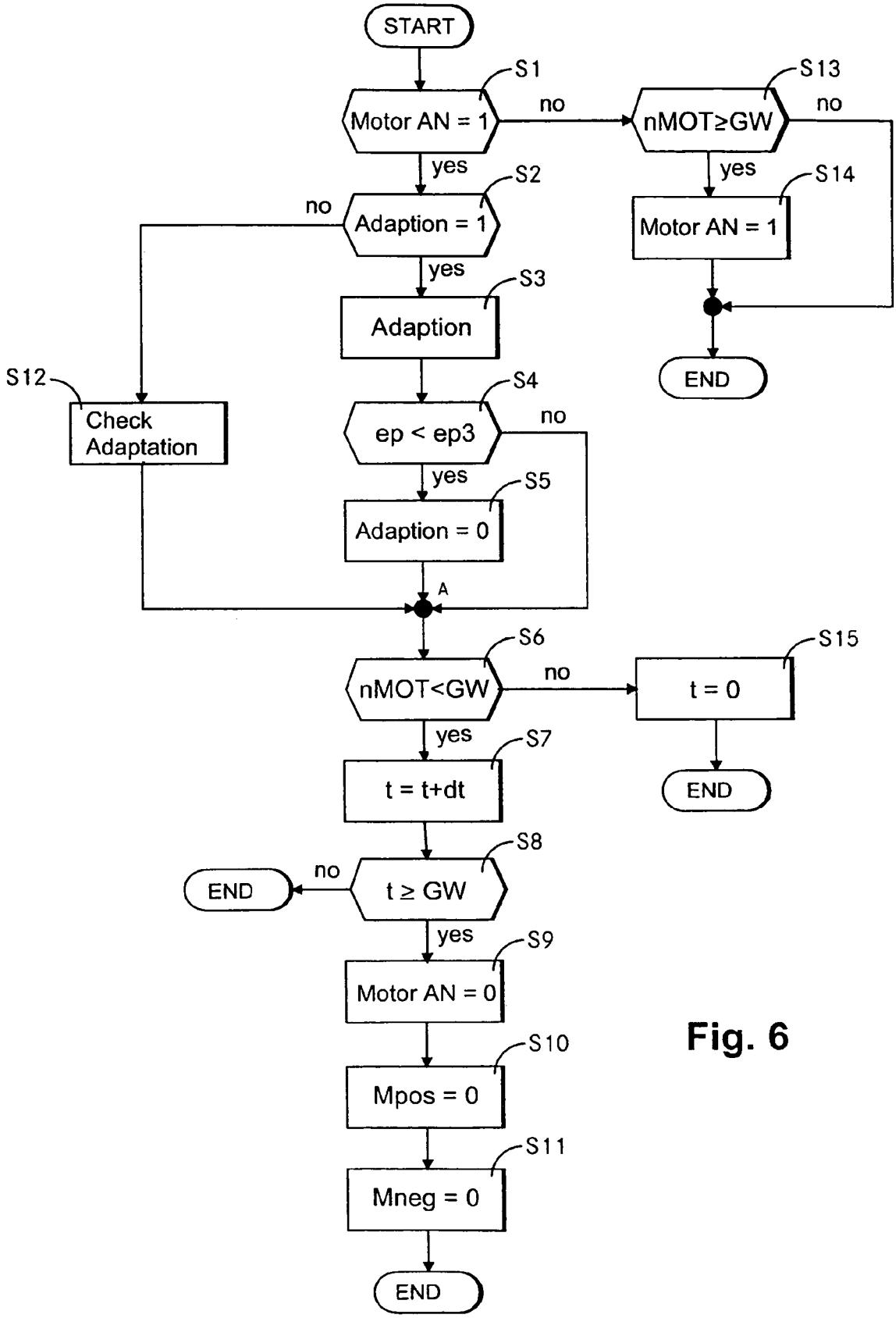
FIG. 6 shows program flow chart.

FIG. 6 shows a program flow chart. After the program has started, the adaptation marker, and the engine-on marker Motor AN are zero initialized. At S1 the program checks to see whether the engine-on signal Motor AN is equal to one, that is, whether the internal combustion engine is running. If this is not the case, the program path proceeds via steps S13 and S14; otherwise, the program proceeds via steps S2-S11.

Figure 7:
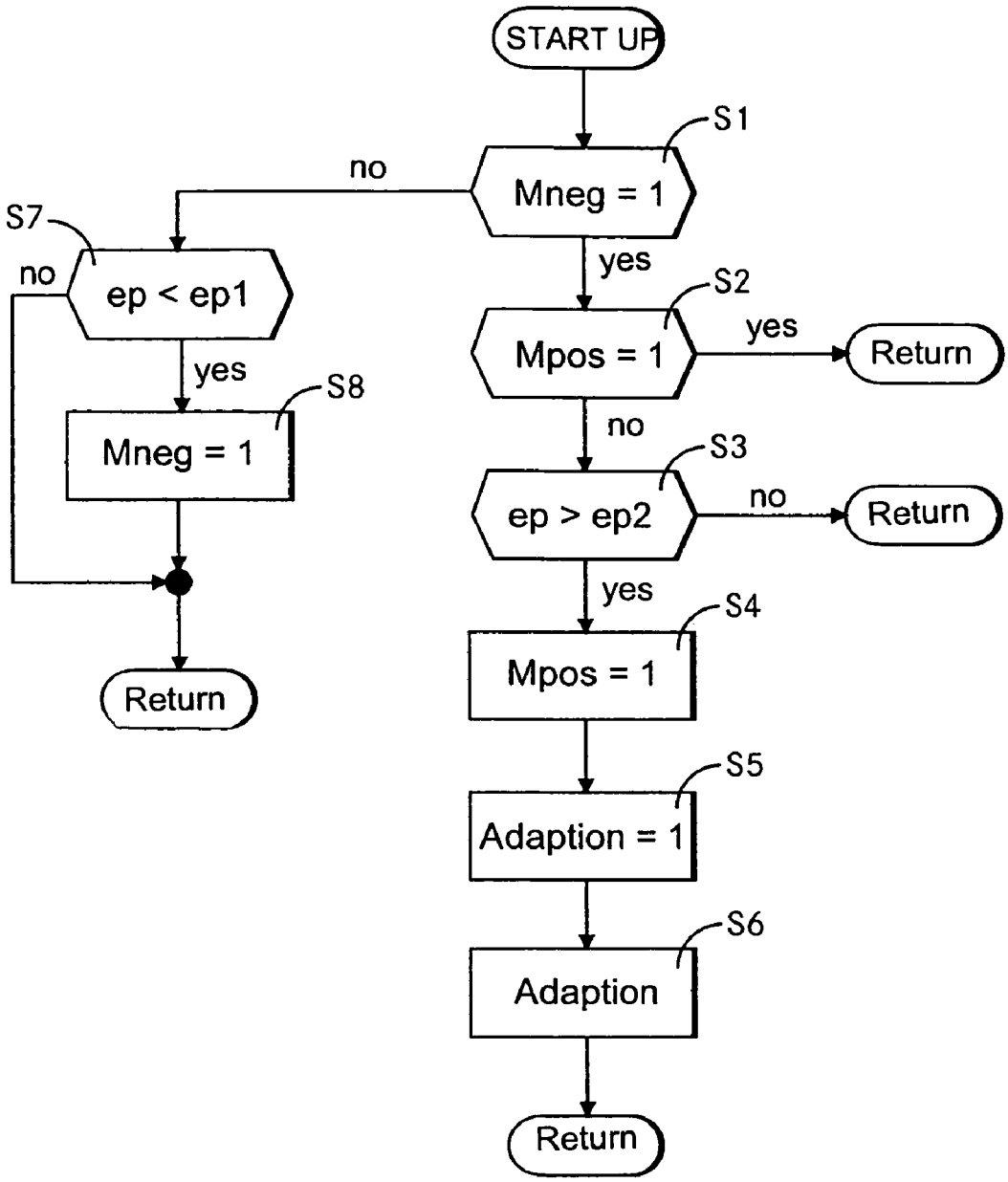
FIG. 7 shows a subroutine flow chart.

If the check at S1 reveals that the engine-on signal Motor AN has not been set, i.e., result S1: no, then, at S13, the program checks to see whether the engine speed nMOT is greater than/equal to a limit value GW, such as 80 rpm. If this is not the case, i.e., result S13: no, then this part of the program terminates. If, however, it is found that the engine speed nMOT is greater than or equal to the limit value GW, i.e., result S13: yes, the engine-on signal Motor AN is set to 1 at S14, and this part of the program terminates. If the check at S1 reveals that the engine-on signal Motor AN has been set, i.e., result S1: yes, then the program checks at S2 to see whether the adaptation process has been activated. If it has not yet been activated, i.e., result S2: no, the program branches to a subroutine "check adaptation" at S12. This is shown in FIG. 7 and is explained in conjunction with that figure. If the check at S2 reveals that adaptation has already been activated, i.e., result S2: yes, the correcting variable is changed at S3 indirectly via the proportional coefficient kp and/or the reset time Tn or directly via the nominal electric current or the PWM signal. At S4, the program checks to see whether the control deviation ep is smaller than a limit value ep3, such as −10 bars. If this is not the case, i.e., result S4: no, the program continues at point A. If the check at S4 shows that the control deviation is smaller than the limit value ep3, i.e. result S4: yes, adaptation is deactivated at S5, and then the program checks at S6 to see whether the speed nMOT of the internal combustion engine is below a limit value GW such as 80 rpm. If this is not the case, i.e., result S6: no, a time stage t is set to zero at S15, and the program terminates. If the check at S6 reveals that the engine speed nMOT is below the limit value GW, i.e., result S6: yes, the time stage t is incremented by one time interval dt at S7. Then the actual status is checked at S8. If the time stage t is below the limit value GW, the program terminates. If the check at S8 reveals that the time stage t is greater than/equal to the limit value GW, i.e., result S8: yes, the two markers Mpos, Mneg and the engine-on signal Motor AN are set to zero at S9, S10, and S11. Thus the program run ends FIG. 7 shows a subroutine, which is used to check whether or not adaptation has been activated. At S1, the program checks to see whether the first marker Mneg has been set. If this is not the case, i.e., result S1: no, the control deviation ep is compared at S7 with a limit value ep1, such as −10 bars, and if the result at S7 is no, the subroutine returns to the main program, or, if the result at S7 is yes, the first marker Mneg is set to one at S8, and then the subroutine returns to the main program of FIG. 6 at point A. If the check at S1 reveals that the first marker Mneg has been set, i.e., result S1: yes, the status of the second marker Mpos is checked at S2. If this has already been set to one, i.e., result S2: yes, the subroutine terminates, and the main program of FIG. 6 resumes at point A. If, however, the check at S2 shows that the second marker Mpos has still not been set, i.e., result S2: no, then the control deviation ep is compared at S3 with a limit value ep2, such as +10 bars. If the deviation is not higher than the limit value ep2, the subroutine terminates, and the main program of FIG. 6 resumes at point A. If the check at S3 reveals that the control deviation ep is higher than the limit value ep2, i.e., result S3: yes, the second marker Mpos is set to one at S4, and adaptation is activated at S5. At S6, the correcting variable is changed so as to increase the fuel delivery rate. The subroutine now terminates, and the main program of FIG. 6 resumes at point A.

From the description given above, it can be seen that the following advantages are offered by the adaptation process according to the invention:

the dependence of the resistance of the suction throttle on temperature is compensated without the need for any expansion of the electronic hardware;

during the starting operation, the actual rail pressure is prevented from falling too far, as a result of which the high-pressure control becomes more robust vis-à-vis temperature fluctuations; and in practice, the internal combustion engine is no longer stops unintentionally during the engine-starting process.

Although the present invention has been described in relation to particular embodiments thereof, many other variations and modifications and other uses will become apparent to those skilled in the art. It is preferred, therefore, that the present invention be limited but by the specific disclosure herein, but only by the appended claims.

The invention claimed is:

1. A process for automatically controlling a rail pressure (pCR) in an internal combustion engine with a common rail system during a starting operation, comprising the steps of:

calculating a control deviation (ep) from a nominal rail pressure (pCR(SL)) and an actual rail pressure (pCR (IST));

calculating a correcting variable, in a pressure controller, for actuating a suction throttle on the basis of the control deviation (ep);

determining, with the suction throttle, a required quantity of fuel; and, after the engine has been started, activating an adaptation process upon detection of a negative control deviation of the rail pressure (pCR) followed by a positive control deviation, as a result of which the correcting variable is changed temporarily so as to increase the amount of fuel being delivered.

2. The process according to claim 1, including changing the correcting variable either indirectly, by way of a change in controller components (PI), or directly.

3. The process according to claim 2, wherein, upon activation of the adaptation process, a P component of the pressure controller is changed by way of a proportional coefficient (kp) and/or an I component of the pressure controller is changed by way of a reset time (Tn).

4. The process according to claim 3, wherein the proportional coefficient (kp) is calculated as a function of a proportional adaptation value (dkp), and the reset time (Tn) is calculated as a function of a reset time adaptation value (dTn).

5. The process according to claim 2, wherein the correcting variable is changed directly, in that a nominal electric current (iSL) or a PWM-signal (PWM) is changed.

6. The process according to claim 5, wherein the nominal electric current (iSL) is changed by way of an adaptation value (di) for the current and the PWM-signal is changed by way of a PWM adaptation value (dPWM).

7. The process according to claim 6, wherein the proportional adaptation value (dkp), the reset time adaptation value (dTn), the adaptation value (di) for the current, and the PWM adaptation value (dPWM) are calculated by using a characteristic adaptation curve (ADAP1, ADAP2) as a function of the control deviation (ep).

8. The process according to claim 1, wherein the adaptation process is deactivated as soon as the control deviation (ep) becomes negative and is locked in the deactivated state until the internal combustion engine is restarted.

* * * * *